US008215713B2

(12) United States Patent
Fiore, Jr. et al.

(10) Patent No.: US 8,215,713 B2
(45) Date of Patent: Jul. 10, 2012

(54) CHILD BOOSTER SEAT WITH A HEIGHT-ADJUSTABLE ARMREST

(75) Inventors: Joseph F. Fiore, Jr., Lebanon, PA (US); Shao-Yue Zhang, Neihu (TW)

(73) Assignee: Wonderland Nurserygoods Company Limited, Central (HK)

( * ) Notice: Subject to any disclaimer, the term of this patent is extended or adjusted under 35 U.S.C. 154(b) by 78 days.

(21) Appl. No.: 12/730,833

(22) Filed: Mar. 24, 2010

(65) Prior Publication Data

US 2010/0244532 A1 Sep. 30, 2010

Related U.S. Application Data

(60) Provisional application No. 61/210,997, filed on Mar. 25, 2009.

(30) Foreign Application Priority Data

Sep. 30, 2009 (CN) ..... 2009 1 0179569

(51) Int. Cl.
*A47C 7/54* (2006.01)
*A47D 1/10* (2006.01)

(52) U.S. Cl. ..... 297/411.36; 297/250.1

(58) Field of Classification Search ..... 297/250.1, 297/411.36, 411.35
See application file for complete search history.

(56) References Cited

U.S. PATENT DOCUMENTS

| | | | | |
|---|---|---|---|---|
| 2,625,987 | A * | 1/1953 | Hunter | 297/174 R |
| 7,104,603 | B2 | 9/2006 | Keegan et al. | |
| 7,673,940 | B2 * | 3/2010 | Fritz et al. | 297/256.11 |
| 2004/0070244 | A1 * | 4/2004 | Williams et al. | 297/250.1 |
| 2004/0195879 | A1 * | 10/2004 | Amirault | 297/250.1 |
| 2007/0069567 | A1 * | 3/2007 | Chen et al. | 297/411.36 |
| 2008/0309140 | A1 * | 12/2008 | Ho | 297/411.36 |

* cited by examiner

*Primary Examiner* — Milton Nelson, Jr.
(74) *Attorney, Agent, or Firm* — Merchant & Gould P.C.

(57) ABSTRACT

A child booster seat includes a seat base, and an armrest support coupled to the seat base and formed with an installation space that opens upward. The armrest support has a wall confronting the installation space and formed with a plurality of restraining parts located at different heights of the armrest support. The child booster seat further includes an armrest assembly including a latching component having a tongue board that extends into the installation space and that is movable vertically within the installation space and a stop piece that projects from the tongue board for engaging selectively the restraining parts, and an armrest component coupled to the tongue board and vertically co-movable with the tongue board relative to the armrest support.

18 Claims, 10 Drawing Sheets

CHILD BOOSTER SEAT WITH A HEIGHT-ADJUSTABLE ARMREST

CROSS-REFERENCE TO RELATED APPLICATION

This application claims priority of U.S. Provisional Application No. 61/210,997, filed on Mar. 25, 2009. This application also claims priority to Chinese Application No. 200910179569.8, filed on Sep. 30, 2009.

BACKGROUND OF THE INVENTION

1. Field of the Invention

This invention relates to a child booster seat, more particularly to a child booster seat with a height-adjustable armrest.

2. Description of the Related Art

A child booster seat may be used to raise the height of a child to assist with feeding the child. One example of a child booster seat design is illustrated in U.S. Pat. No. 7,104,603. In the prior art, the armrest of the child booster is not easy to operate while a caregiver wants to adjust the height of the armrest for a child seating on the seat. Accordingly, the design and operation of a child booster seat may still be improved.

SUMMARY OF THE INVENTION

The object of the present invention is to provide a child booster seat with a height-adjustable armrest that is relatively easy to adjust.

According to the present invention, a child booster seat includes a seat base, and an armrest support coupled to the seat base and formed with an installation space that opens upward. The armrest support has a wall confronting the installation space and formed with a plurality of restraining parts located at different heights of the armrest support. The child booster seat further includes an armrest assembly that includes a latching component, which includes a tongue board that extends into the installation space and that is movable vertically within the installation space and a stop piece that projects from the tongue board for engaging selectively the restraining parts.

The armrest assembly further includes an armrest component that is coupled to the tongue board and that is vertically co-movable with the tongue board relative to the armrest support. The armrest component is supported at a selected height of the armrest support when the stop piece engages one of the restraining parts. The tongue board is operable to move the stop piece relative to the armrest component for disengaging the restraining parts and permitting height adjustment of the armrest assembly relative to the armrest support.

Preferably, the armrest component is formed with a slot that opens upward and an access opening in spatial communication with the slot. The tongue board is received in the slot, and the stop piece protrudes through the access opening when the stop piece engages one of the restraining parts-Preferably, the armrest assembly further includes a pressing component that is installed on the armrest component and that has a pressing side and a pushing side. The pushing side abuts against the tongue board of the latching component such that a horizontal force on the pressing side is transmitted to the tongue board to move the stop piece relative to the armrest component for disengaging the restraining parts.

Preferably, the pressing component is located at a height position between the stop piece and a coupling junction between the tongue board and the armrest component.

Preferably, the child booster seat further includes a position limiting mechanism provided on the armrest support and the armrest component for limiting vertical movement of the armrest component relative to the armrest support.

Preferably, the position limiting mechanism includes a hole-defining portion that is provided on one of the wall of the armrest support and the armrest component and that defines a position limiting hole, and a position limiting block that is provided on the other one of the wall of the armrest support and the armrest component and that extends into the position limiting hole to limit the vertical movement of the armrest component relative to the armrest support.

Preferably, the armrest assembly further includes a return spring located between the tongue board and the armrest component for biasing the tongue board to move the stop piece toward the restraining parts.

Preferably, the tongue board has one end that is opposite to the stop piece and that is pivotable relative to the armrest component about a horizontal axis.

Preferably, one of the tongue board and the armrest component is formed with an indentation, and the other one of the tongue board and the armrest component is formed with a protrusion. The return spring has a first spring end sleeved on the protrusion and a second spring end received in the indentation.

Preferably, the restraining parts include a first stop opening and a second stop opening that are formed in the armrest support and that are vertically spaced apart from each other.

Preferably, the restraining parts include vertically spaced apart upper and lower arc edges on the wall of the armrest support, and the stop piece has a peripheral contour conforming with those of the upper and lower arc edges. Preferably, the armrest component includes a vertical board portion that is formed with the access opening, and a horizontal board portion that is connected to a top end of the vertical board portion and that is formed with the slot. The tongue board has a top portion that is connected to the horizontal board portion, and an extension portion that extends downwardly from the top portion, that is received in the slot, and that is formed with the stop piece.

Preferably, the position limiting mechanism includes a limit block protruding from the vertical board portion, and a stop block protruding from the armrest support into the installation space and vertically aligned with the limit block. Engagement between the limit block and the stop block prevents the armrest assembly from separating from the armrest support when the armrest assembly is moved vertically upward relative to the armrest support.

Preferably, the extension portion is deformable by a horizontal force to move the stop piece relative to the armrest component for disengaging the restraining parts.

Preferably, the extension portion is resilient and biases the stop piece toward the restraining parts.

In the present invention, the armrest assembly can be disengaged from the armrest support to allow the armrest assembly to be adjusted to a desired height.

BRIEF DESCRIPTION OF THE DRAWINGS

Other features and advantages of the invention will become apparent in the following detailed description with reference to the accompanying drawings, of which.

DETAILED DESCRIPTION OF THE EMBODIMENTS

Figure 1:
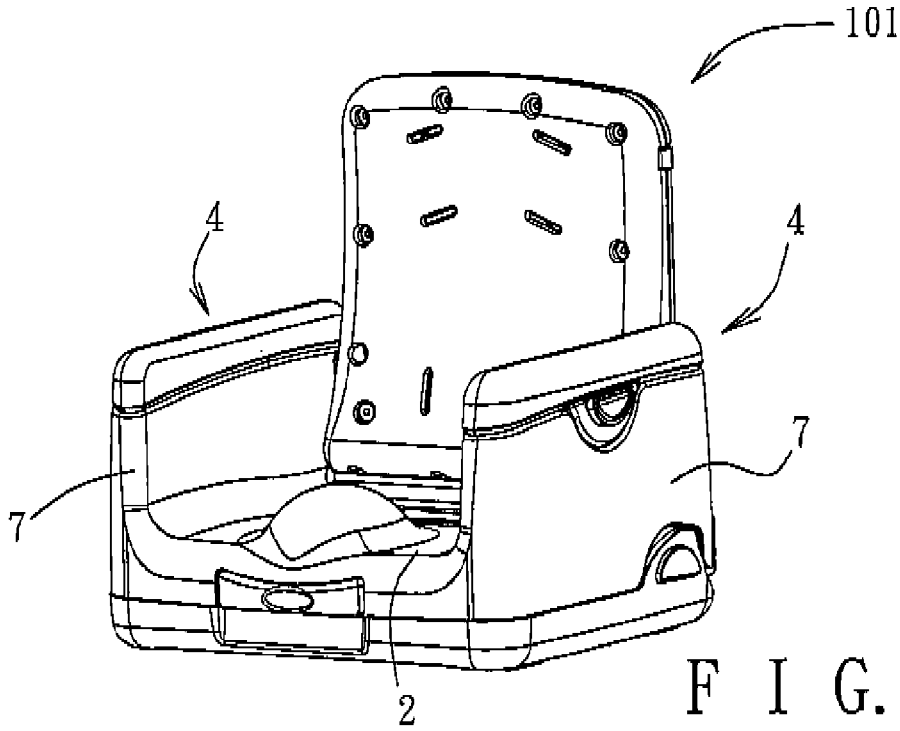
FIG. 1 is a perspective view of a child booster seat, according to a first embodiment.
Figure 2:
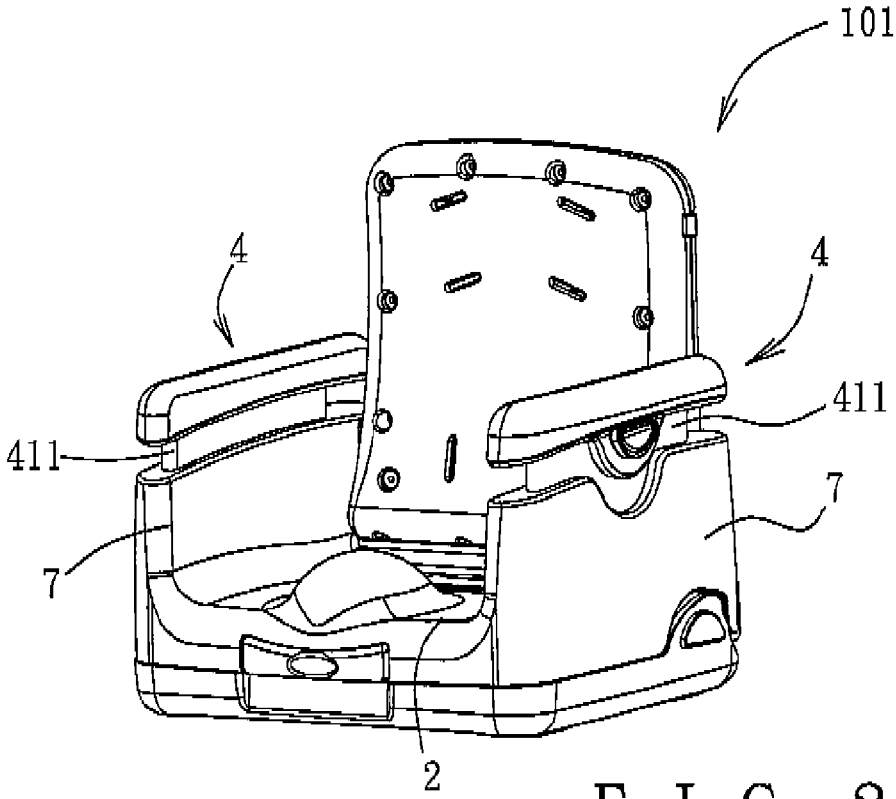
FIG. 2 is another perspective view illustrating the child booster seat with a height adjustable armrest assembly, according to the first embodiment.
Figure 3:
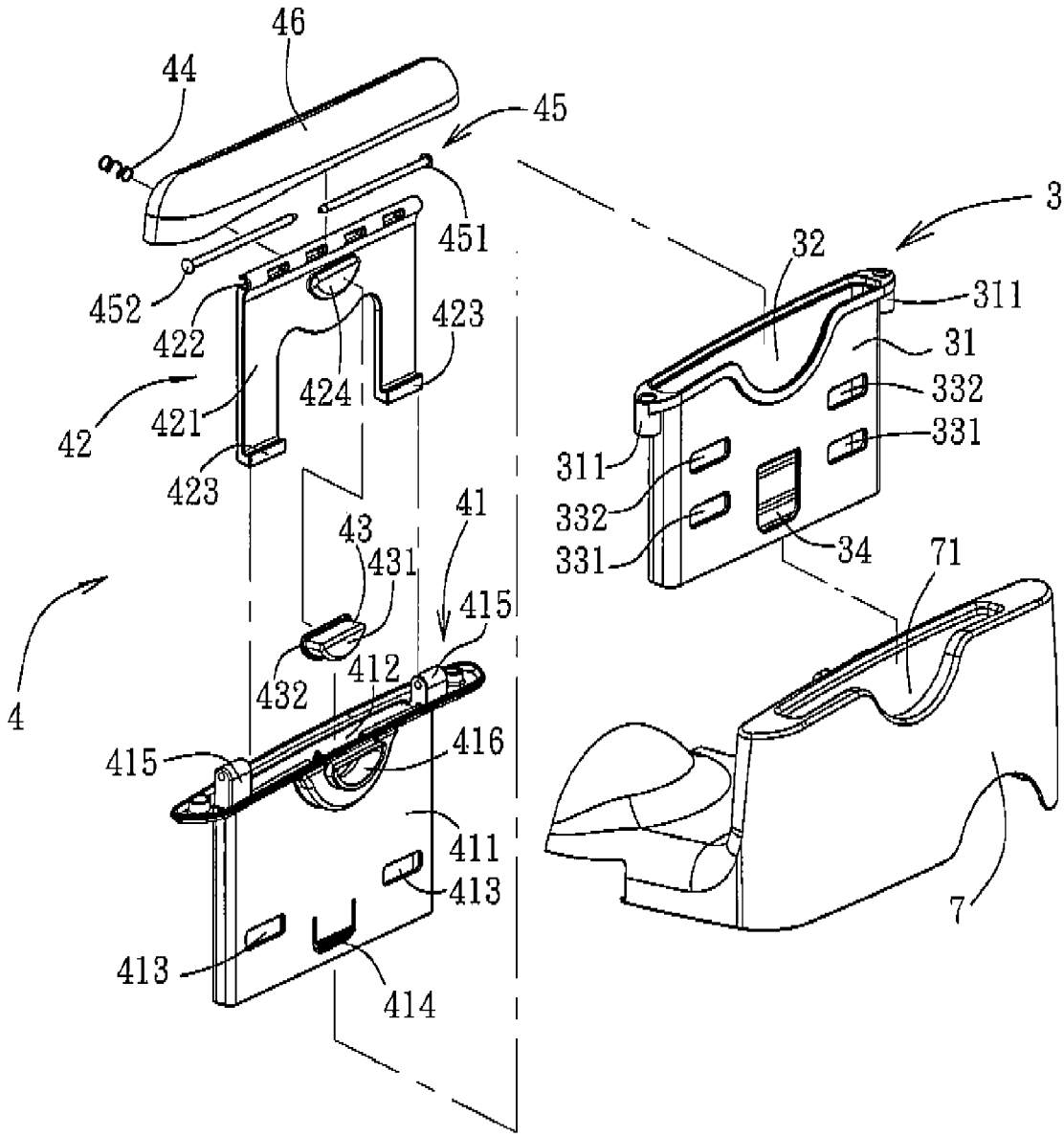
FIG. 3 is an exploded perspective view illustrating an armrest support and an armrest assembly, according to the first embodiment.

Referring to FIGS. 1, 2 and 3, the first preferred embodiment of a child booster seat 101 according to this invention includes a seat base 2, a pair of armrest supports 3, a pair of armrest assemblies 4, and a pair of armrest support housings 7. The armrest support housings 7 are located at two sides of the seat base 2 and are integrally formed with the seat base 2. Each of the armrest support housings 7 is formed with a receiving slot 71. The two armrest supports 3 are each disposed in one of the receiving slots 71 of the armrest support housings 7. As shown in FIG. 3, each of the armrest supports 3 is fixed in one of the armrest support housings 7 that are connected to the sides of the seat base 2. An armrest assembly 4 is disposed in each armrest support 3. The armrest assembly 4 is capable of moving upwards and downwards relative to the armrest support 3 to adjust the height of the armrest assembly 4.

Referring to FIG. 3, each of the armrest supports 3 includes a support body 31 formed with an installation space 32, a pair of first stop openings 331, a pair of second stop openings 332, and a position limiting hole 34. The support body 31 is fitted in the receiving slot 71. The top of the support body 31 is provided with a pair of fixing parts 311 to fasten the armrest supports 3 in the receiving slots 71 of the armrest support housings 7 with the use of screws (not shown). The installation space 32 is formed between a pair of confronting lateral walls of the support body 31 and has an upwardly facing opening. The first stop openings 331 are spaced apart from each other and are formed on left and right sides of one of the lateral walls of the support body 31. The second stop openings 332 are also spaced apart from each other, are formed on left and right sides of the one of the lateral walls, and are spaced apart from and disposed above the first stop openings 331, respectively. The position limiting hole 34 is located between the first stop openings 331 and has a vertical length larger than the distance between the top edges of the first stop openings 331 and the bottom edges of the second stop openings 332.

Figure 4:
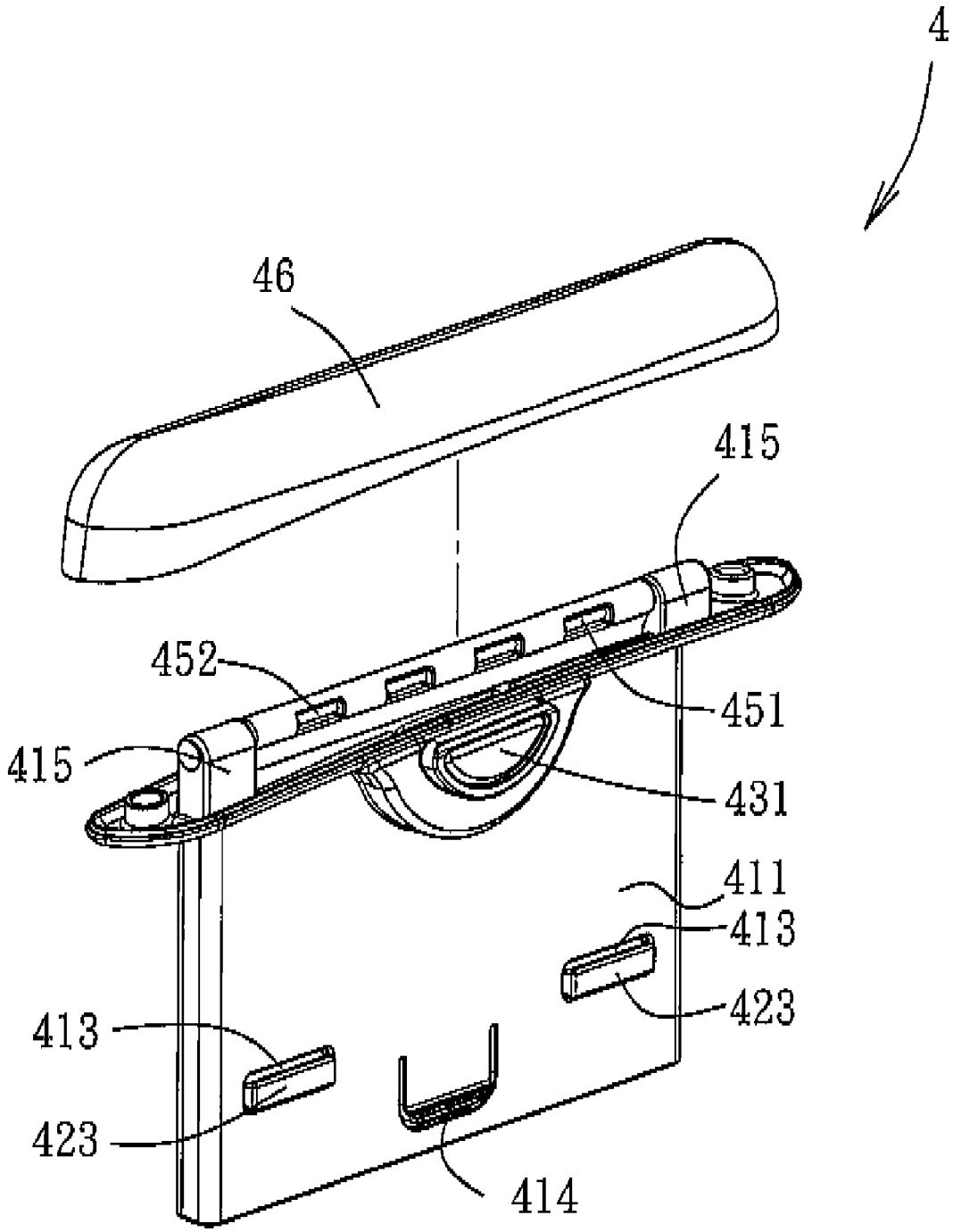
FIG. 4 is an exploded perspective view illustrating the armrest assembly, according to the first embodiment.

Referring to FIGS. 3 and 4, each of the armrest assemblies 4 includes an armrest component 41, a latching component 42, a pressing component 43, a return spring 44, a pivot axle 45, and an armrest cover 46. The armrest component 41 includes an armrest component body 411 that can be installed in and displaced up and down within the installation space 32. The armrest component 41 has an upwardly opening slot 412 formed in the armrest component body 411 and a pair of access openings 413 formed on a lateral side of the armrest component body 411. The access openings 413 are capable of being brought into alignment with the first stop openings 331 or the second stop openings 332 when the armrest component body 411 is displaced upwards and downwards in the slot 412.

The armrest component 41 further has a position limiting block 414 protruding from the armrest component body 411 and extending into the position limiting hole 34, such that, when the armrest component 41 moves upward to the extent that the position limiting block 414 abuts against the top edge of the position limiting hole 34, the armrest component 41 is stopped from further upward movement and is prevented from separating from the corresponding armrest support 3.

Moreover, the armrest component 41 further includes a pair of pivot base parts 415 that are located at the top of the armrest component body 411. The pivot base parts 415 are preferably adjacent to the upward opening of the slot 412 and are spaced apart from each other. The armrest component 41 further has a receiving hole 416 for the pressing component 43 to extend through. The top of the armrest component 41 is formed to couple with the armrest cover 46 to cover the pivot base parts 415, the purpose of which will be further described below.

The latching component 42 includes a tongue board 421 with a forked bottom section and a top edge configured with an axle hole 422, and a pair of protruding stop pieces 423 at the bottom of the tongue board 421. The tongue board 421 is installed between the pivot base parts 415 of the armrest component 41, and the pivot axle 45 extends through the pivot base parts 415 and the axle hole 422 formed on the top edge of the tongue board 421, such that the latching component 42 can pivot about a horizontal axis with respect to the armrest component 41.

The stop pieces 923 may pass through the first stop openings 331 or the second stop openings 332 via the access openings 413. By extending the stop pieces 423 through the access openings 413 and either the first stop openings 331 or the second stop openings 332, the armrest assembly 4 is securely positioned with respect to the corresponding armrest support 3.

The pressing component 43 extends through the receiving hole 416 of the armrest component 91 and abuts against the tongue board 421 of the latching component 42. The pressing component 43 has a pressing side 431 accessible from the respective one of the armrest supports 3, and a pushing side 432 extending from the pressing side 431. The pushing side 432 contacts the tongue board 421 of the latching component 42, such that a horizontal force exerted on the pressing side 432 can be relayed to the tongue board 421. This enables the stop pieces 423 to be moved away from the first stop openings 331 or the second stop openings 332, which allows adjustment of the position or height of the armrest assembly 4 relative to the corresponding armrest support 3.

In the embodiment, the tongue board 421 of the latching component 42 has an outer side formed with a protrusion 424 to abut against the pressing component 43. In addition, as illustrated in FIG. 3, the pressing component 43 is positioned by the receiving hole 416 of the armrest component 41 such that the pressing component 43 contacts the latching component 42 at a height position of the tongue board 421 between the axle hole 422 and the stop pieces 423.

Figure 5:
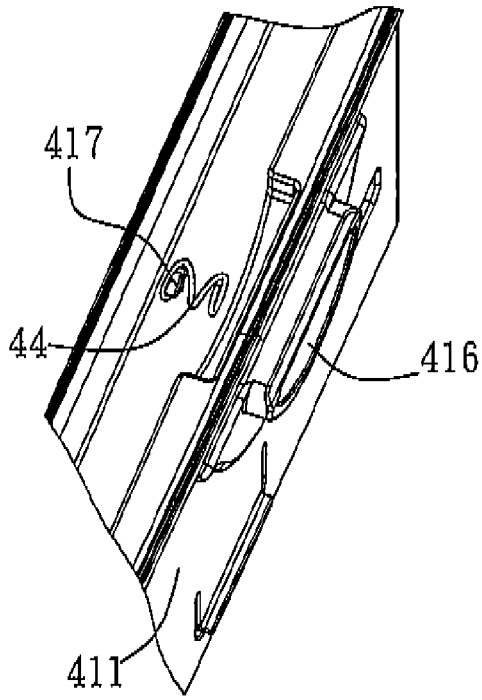
FIG. 5 is a fragmentary perspective view illustrating a raised part of an armrest component, according to the first embodiment.
Figure 6:
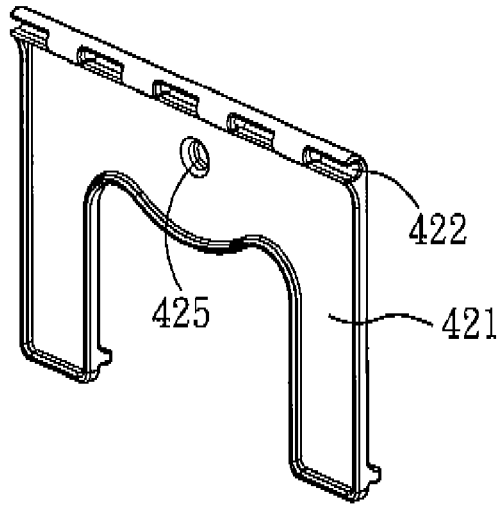
FIG. 6 is a perspective view illustrating an indentation of a latching component of the armrest assembly, according to the first embodiment.
Figure 8:
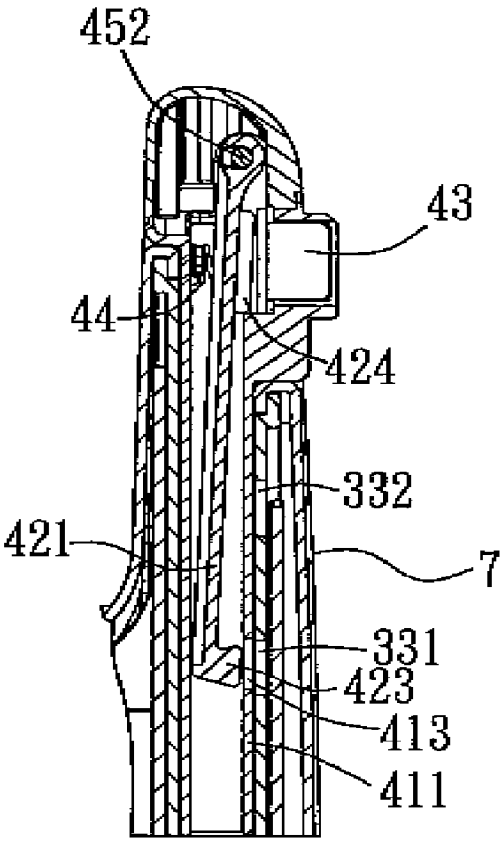
FIG. 8 is a fragmentary schematic sectional view illustrating the stop piece separated from the first stop opening, according to the first embodiment.
Figure 7:
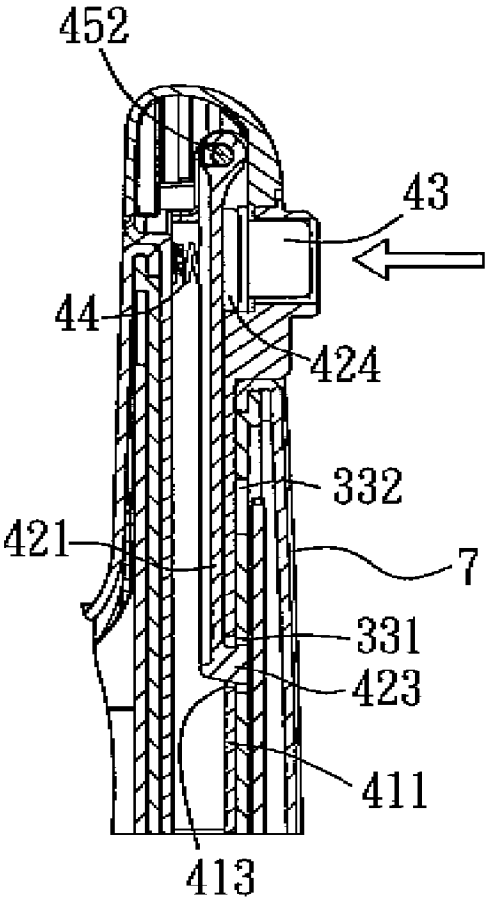
FIG. 7 is a fragmentary schematic sectional view illustrating a stop piece of the latching component in a first stop opening, according to the first embodiment.
Figure 10:
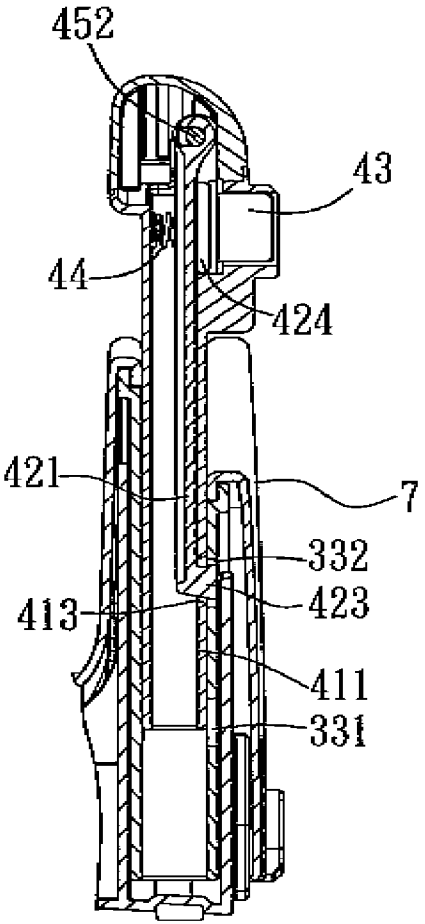
FIG. 10 is a fragmentary schematic sectional view illustrating the stop piece in the second stop opening, according to the first embodiment.
Figure 9:
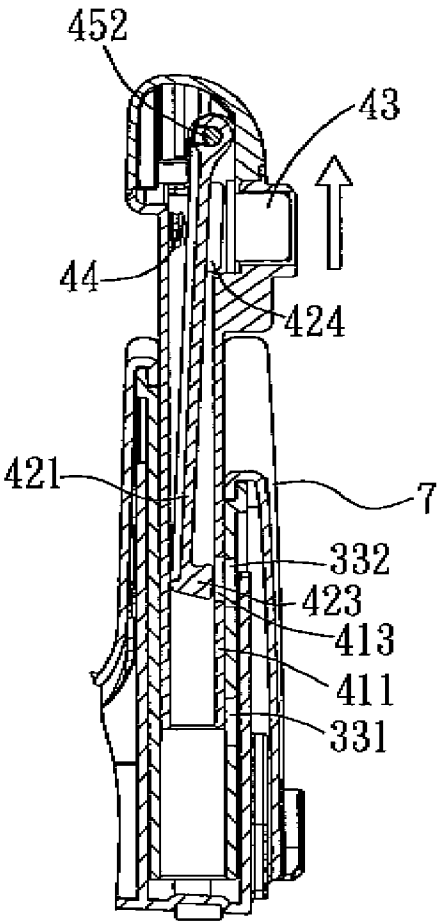
FIG. 9 is a fragmentary schematic sectional view illustrating the stop piece of the latching component that is moved toward a second stop opening, according to the first embodiment.

Referring to FIGS. 3, 5 and 6, the return spring 44 is located between the tongue board 421 of the latching component 42 and the armrest component 41. In the embodiment, the tongue board 421 of the latching component 42 has a face with an indentation 425, and the armrest component 41 has a protrusion 417 extending from an inner lateral wall. One end of the return spring 44 is sleeved on the protrusion 417, and the other end of the return spring 44 is received in the indentation 425. In such a manner, the return spring 44 biases the latching component 42 toward the lateral wall of the armrest component body 411 of the armrest component 41 that is formed with the access opening 413. The return spring 44 may be mounted such that it applies a horizontal return force when it is compressed or expanded. In other words, the above assembly applies a force to maintain the insertion of each stop piece 423 of the latching component 42 through the corresponding access opening 413 and either the corresponding first stop opening 331 or the corresponding second stop opening 332 to hold a secure position.

The pivot axle 45 has a first section 451 and a second section 452. Because the tongue board 421 of the latching component 42 is located between the corresponding pivot base parts 415, and the axle hole 422 formed on the top edge of the tongue board 421 may be aligned with the pivot base parts 415, by extending each of the first section 451 and the second section 432 of the pivot axle 45 through the respective pivot base part 415 and the axle hole 422, the latching component 42 is connected pivotably to the armrest component 41 and is capable of being displaced in the slot 412 by being rotated about the pivot axle 45.

Referring to FIGS. 7 to 10, when a user wants to adjust the armrest assembly 4 higher, by depressing the pressing component 43, the tongue board 421 of the latching component 42 moves away from the first stop openings 331 and compresses the return spring 44. This movement of the tongue board 421 separates the stop pieces 423 located at the bottom end of the tongue board 421 from the first stop openings 331, thereby disengaging the fastening between the armrest assembly 4 and the armrest support 3. The user may then pull the armrest assembly 4 upwards until the stop pieces 423 reach the second stop openings 332.

After the external force on the pressing component 43 is released, the return force of the return spring pushes the tongue board 421 of the latching component 92 return. The movement of the tongue board 421 causes a linked movement of the stop pieces 423, extending the stop pieces 423 through the access openings 413 and into the second stop openings 332, thereby securely positioning the armrest assembly 4 and the corresponding armrest support 3.

On the other hand, when adjusting the armrest assembly 4 to a lower height, the pressing component 43 may be depressed to disengage the stop pieces 423 from the second stop openings 332. The user can then move the armrest assembly 4 downwards until the stop pieces 423 reach the first stop openings 331. At this time, the stop pieces 423 can be extended through the access openings 413 and into the first stop openings 331, again securely positioning the armrest assembly 4 and the corresponding armrest support 3. The pressing component 43 may be released when the stop pieces 423 are aligned with the first stop openings 331, or in other embodiments, prior to the time the stop pieces 423 are moved into alignment with the first stop openings 331.

The tongue board 421 can be displaced by the return spring 44 or the pressing component 43 such that the tongue board 421 is pivoted about a horizontal axis with respect to the armrest component 41. The movement of the tongue board 421 of the latching component 42 causes a linked movement of the stop pieces 423. In other embodiments, the tongue board 421 may be pushed or pulled through direct contact by a user to displace the tongue board 421 and to cause a linked movement of the stop pieces 423. The direct contact may be made through the receiving hole 416 or through an open space of the armrest support 3. Alternatively, the tongue board 421 may include a protrusion that may be pulled or rotated to cause the tongue board 421 to be displaced.

The linked movement of the stop pieces 423 may cause them to be extended into or retracted from the access openings 413 and engaged or disengaged with the first stop openings 331 or the second stop openings 332. In such a manner, the armrest assembly 4 can be secured to or disengaged from the corresponding armrest support 3, allowing the height of the armrest assembly 4 to be adjusted to provide a comfortable resting position for arms of a child. Although in the embodiment, the first stop openings 331 and the second stop openings 332 are used to adjust the height of the armrest assembly 4, additional or fewer stop openings may be provided for height adjustment of the armrest assembly 4 in accordance with practical requirements.

In the embodiment, the first stop openings 331 and the second stop openings 332 act as restraining parts for holding the armrest assembly 4 and the armrest support 3 in a fixed relative vertical position when the stop pieces 423 are extended through the access openings 413 to engage a restraining part, such as the first stop openings 331 or the second stop openings 332. In other embodiments, the restraining parts may include protrusions, openings, ridges, interlocking, or other components that interact with the stop pieces 423 and that may be used to restrict relative vertical movement between the armrest assembly 4 and the armrest support 3. For example, in other embodiments, each stop piece 423 may include an opening that receives a corresponding protruding restraining part of the armrest support 3.

Figure 11:
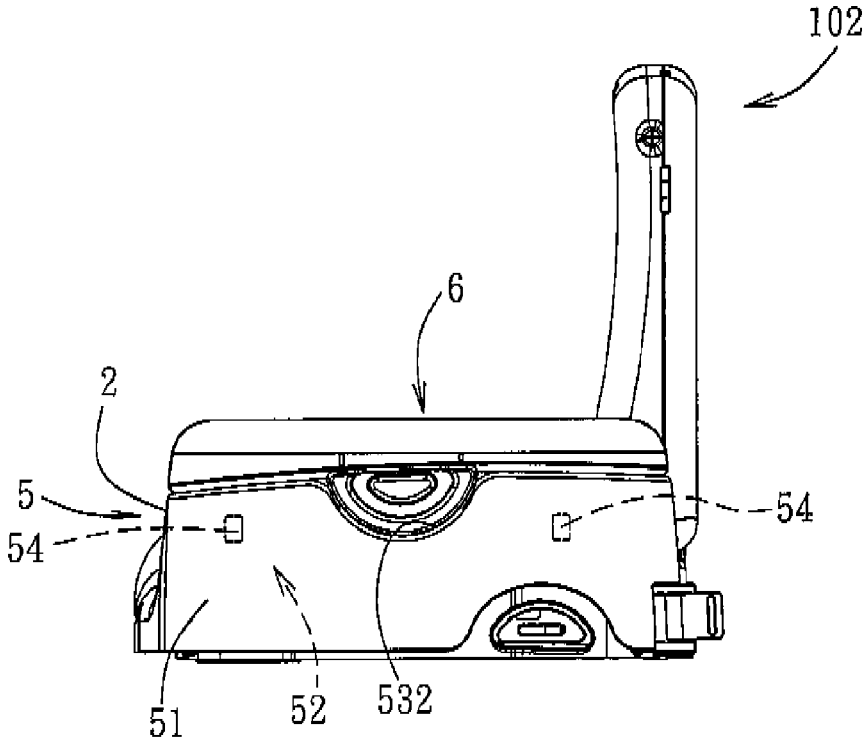
FIG. 11 is a schematic side view of a child booster seat, according to a second embodiment.
Figure 12:
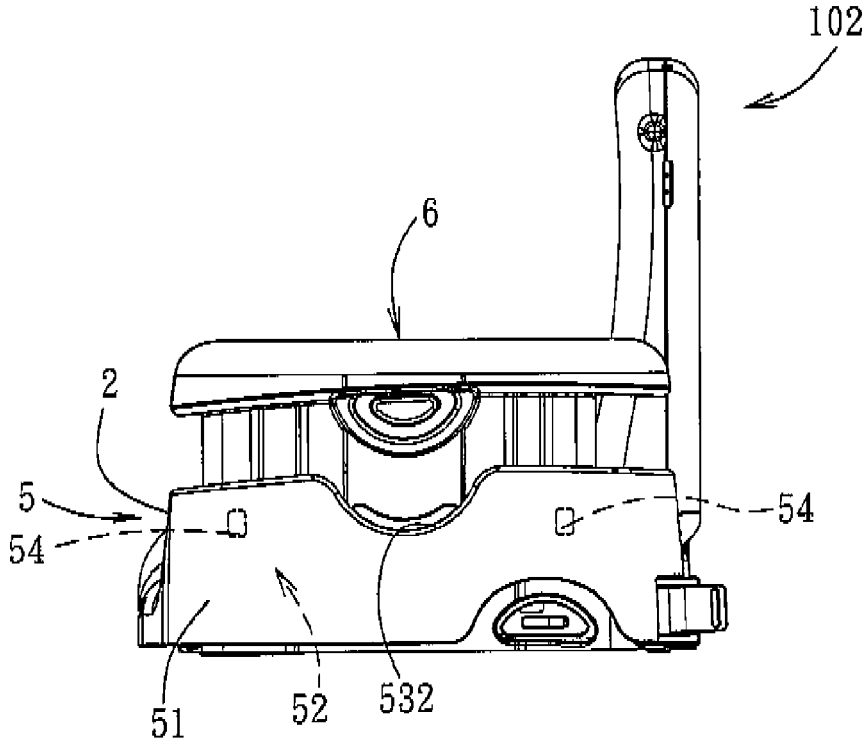
FIG. 12 is another schematic side view illustrating the child booster seat with a height adjustable armrest assembly, according to the second embodiment.

Referring to FIGS. 11 and 12, the second preferred embodiment of a child booster seat 102 according to this invention includes a seat base 2, a pair of armrest supports 5, and a pair of armrest assemblies 6 (due to the viewing angle, only one armrest support 5 and one armrest assembly 6 are shown in the Figures). In the embodiment, the armrest assemblies 6 are adjustable between two different height positions. As shown in FIGS. 11 and 12, the different height positions of the armrest assemblies 6 are a comparatively lower height position and a comparatively higher height position. In the embodiment, the armrest supports 5 are located at two sides of the seat base 2 and are integrally formed with the seat base 2. The armrest assemblies 6 are installed in the armrest supports 5, respectively. The armrest assemblies 6 may be moved upwards and downwards relative to the respective armrest supports 5 to adjust the height of the armrest assemblies 6.

Figure 15:
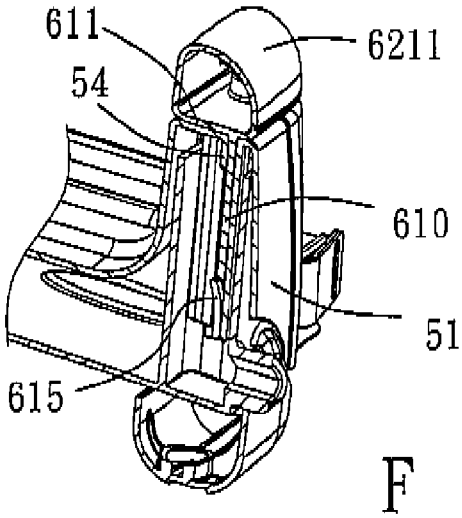
FIG. 15 is a fragmentary partly cutaway perspective view illustrating a position limiting block of an armrest component of the armrest assembly and a stop piece of a latching component, according to the second embodiment.
Figure 16:
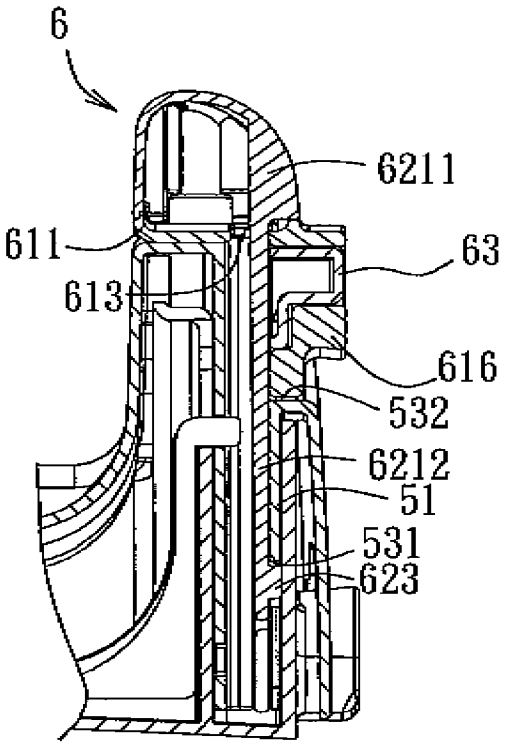
FIG. 16 is a fragmentary schematic sectional view illustrating the stop piece located at a lower arc edge, according to the second embodiment.

Referring to FIGS. 12, 15 and 16, each of the armrest supports 5 includes a seat body 51 formed with an installation space 52, a lower arc edge 531, an upper arc edge 532, and a pair of stop blocks 54. The installation space 52 is formed with an upwardly facing opening in the seat body 51 and is confined between a pair of confronting lateral walls of the seat body 51. The upper arc edge 532 and the lower arc edge 531 are formed at respective higher and lower locations of one of the lateral walls of the seat body 51 of the armrest support 5. In the embodiment, the lower arc edge 531 is formed by the upper boundary of an opening in the one of the lateral walls of the seat body 51, and the upper arc edge 532 is formed by a lower boundary of an opening in the one of the lateral walls of the seat body 51, with the upper are edge 532 being located above the lower arc edge 531. The upper arc edge 532 and the lower arc edge 531 are located approximately in the middle of the one of the lateral walls between the left and right sides of the one of the lateral walls.

The stop blocks 54 protrude from an inner wall of the seat body 51 and into the installation space 52. In the embodiment, the stop blocks 54 are located such that the upper arc edge 532 and the lower arc edge 531 are formed between the left and right positions of the stop blocks 54 on the inner well of the seat body 51. The stop blocks 54 are located approximately at the height position of the upper arc edge 532. In other embodiments, one or more stop blocks 54 may be used, and the stop blocks 54 may be formed by a ledge, an opening, or other surface that may oppose upwards travel of a corresponding surface or object. In addition, the stop blocks 54 may be located above or below the height position of the upper arc edge 532.

Figure 13:
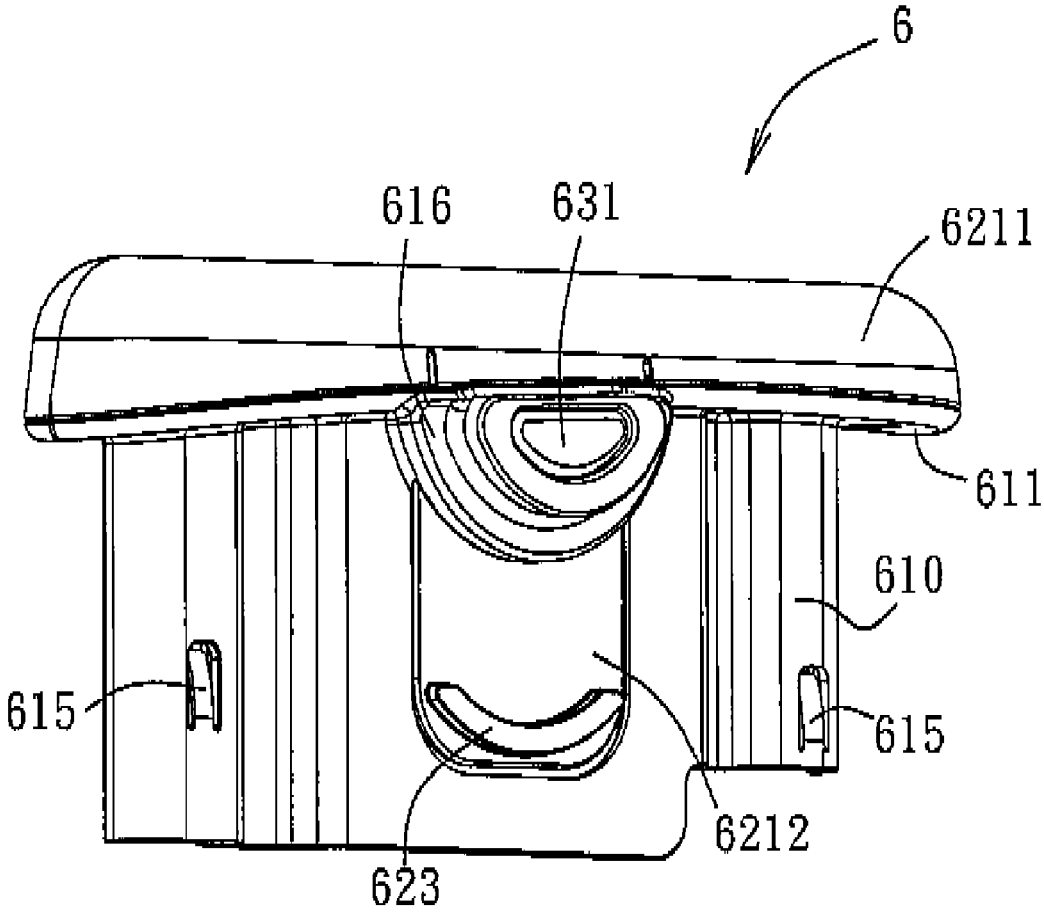
FIG. 13 is an assembled perspective view illustrating the armrest assembly of the second preferred embodiment.
Figure 14:
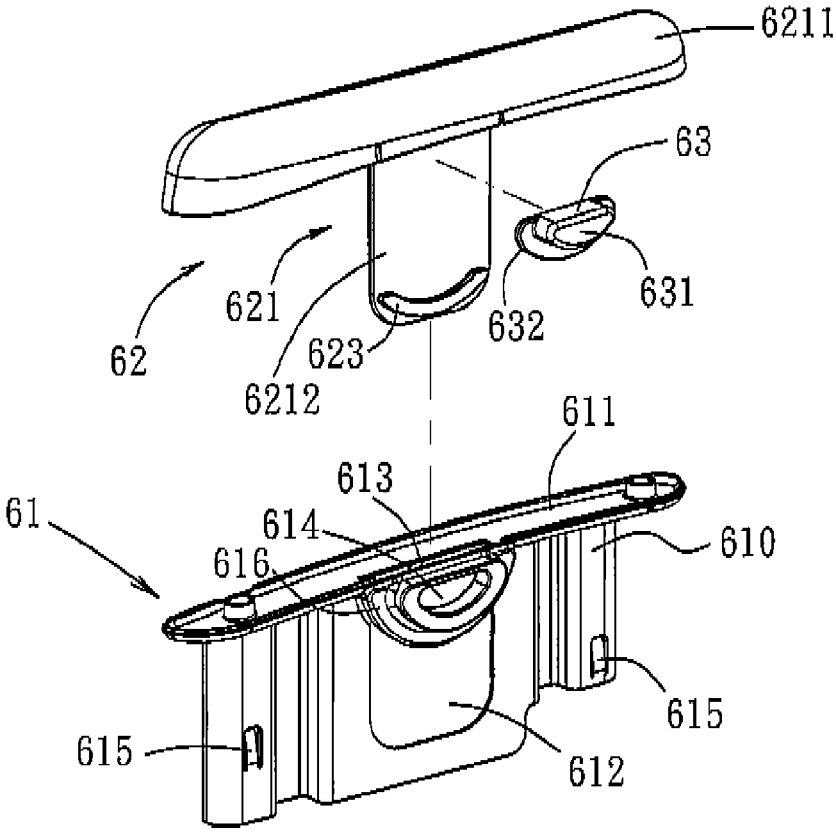
FIG. 14 is an exploded perspective view illustrating an armrest component, a latching component, and a pressing component, according to the second embodiment.

Referring to FIGS. 13 and 14, each of the armrest assemblies 6 includes an armrest component 61, a latching component 62, and a pressing component 63. The armrest component 61 includes a vertical board portion 610 formed with an access opening 612 and a receiving hole 614. In the embodiment, the vertical board portion 610 is installed in the installation space 52 of the seat body 51 such that the armrest assembly 6 may be moved upwards and downwards.

The access opening 612 is formed at an area between the left and right sides of the vertical board portion 610 and below the receiving hole 614. The access opening 612 is further aligned vertically with the upper arc edge 532 and the lower arc edge 531. The vertical board portion 610 includes a raised platform 616, which is located at the top of the access opening 612 and which is formed with the receiving hole 614. The pressing component 63 passes through the receiving hole 614. The raised platform 616 protrudes from a wall of the vertical board portion 610 such that a lower boundary of the raised platform 616 may conform to and abut against the upper arc edge 532 when the armrest assembly 6 is at a lowered position. The lower boundary of the raised platform 616 may limit the downward travel of the armrest assembly 6 when the armrest assembly 6 is installed in the installation space 52 of the seat body 51.

The armrest component 61 also includes a horizontal board portion 611 connected to a top of the vertical board portion 610. A slot 613 is formed in the middle of the horizontal board portion 611 that allows the latching component 62 to be inserted and installed in the slot 613. The horizontal board portion 611 may conform to and abut against an upper end of the seat body 51 to limit downward travel of the armrest assembly 6 when the latter is installed in the installation space 52 of the seat body 51.

Moreover, as shown in FIGS. 14 and 15, the armrest component 61 further includes a pair of position limiting blocks 615. The position limiting blocks 615 are formed by indenting a side of the vertical board portion 610 to create protrusions into the installation space 52 and adjacent to the lateral wall with the stop blocks 54. The position limiting blocks 615 are located on left and right sides of the vertical board portion 610 with the access opening 612 located between the position limiting blocks 615. The position limiting blocks 615 are located approximately at a height position of the bottom edge of the access opening 612. The position limiting blocks 615 protrude from the vertical board portion 610 to align with the stop blocks 54.

When the armrest assembly 6 is moved upwards, the position limiting blocks 615 on the vertical board portion 610 are moved upwards until they abut against the stop blocks 54 on the seat body 51, thereby preventing separation of the armrest assembly 6 from the armrest support 5. In other embodiments, one or more position limiting blocks 615 may be used, and the position limiting blocks 615 may be installed at the same height, above, or below the bottom edge of the access opening 612.

Referring to FIGS. 13, 14 and 16, the latching component 62 passes through and is installed in the slot 613 of the armrest component 61. The latching component 62 includes a tongue board 621 that extends along the vertical board portion 610, both horizontally across and downwards next to the vertical board portion 610. The tongue board 621 has a top portion 6211 assembled to the horizontal board portion 611 and an extension portion 6212 to be inserted into and mounted within the slot 613. In such a manner, the latching component 62 is connected to the armrest component 61.

The latching component 62 further has a stop piece 623 protruding from the bottom part of the extension portion 6212 for extending through the access opening 612 and abutting against either the lower arc edge 531 and the upper arc edge 532. The stop piece 623 also takes an arc shape and is configured to contact closely with the lower arc edge 531 or the upper arc edge 532. As such, by virtue of the stop piece 623 extending through the access opening 612 and contacting with either the lower arc edge 531 or the upper arc edge 532, the armrest assembly 6 may be securely supported on the corresponding armrest support 5. In the embodiment, the stop piece 623 is large enough to provide adequate support for a user's arm, and the top portion 6211 is shaped like the armrest cover 46 in the first preferred embodiment.

Referring to FIGS. 14 and 16, the pressing component 63 extends through the receiving hole 614 of the armrest component 61 and abuts against the tongue board 621 of the latching component 62. The pressing component 63 has a pressing side 631 and a pushing side 632. The pressing side 631 is accessible outside of a respective armrest support 5 to allow the pressing component 63 to be pressed. The pushing side 632 abuts against the tongue board 621 of the latching component 62, such that a horizontal force exerted on the pressing side 631 can be relayed to the tongue board 621. The tongue board 621 can then separate the stop piece 623 from the interference position with the upper arc edge 532 or the lower arc edge 531, thus releasing the armrest assembly 6 from a secured position to allow the armrest assembly 6 to be moved up or down in the installation space 52. The pressing component 63 contacts the tongue board 621 at a location between the stop piece 623 and the connection between the tongue board 621 and the armrest component 61.

By fixing the top portion 6211 to the horizontal board portion 611, the extension portion 6212 is suspended downwards. By pushing the pressing component 63, the extension portion 6212 may be moved horizontally and the stop piece 623 may be separated with the upper arc edge 532 or the lower arc edge 531. Due to a bending moment on the tongue board 621, which caused by the pushing at the pressing component 63 and a distance between the pressing component 63 and the fixed end of the top portion 6211, and the resiliency of the material from which the extension portion 6212 is formed, the extension portion 6212 has an inherent return force. Hence, when the pressing component 63 is no longer depressed, the extension portion 6212 is restored to its original position. In other words, the resiliency of the extension portion 6212 biases the stop piece 623 towards the lower arc edge 531 or the upper arc edge 532. A return spring may also be installed between the extension portion 6212 and the pressing component 63 to increase the horizontal return force to bring the pressing component 63 back to its former position.

Figure 17:
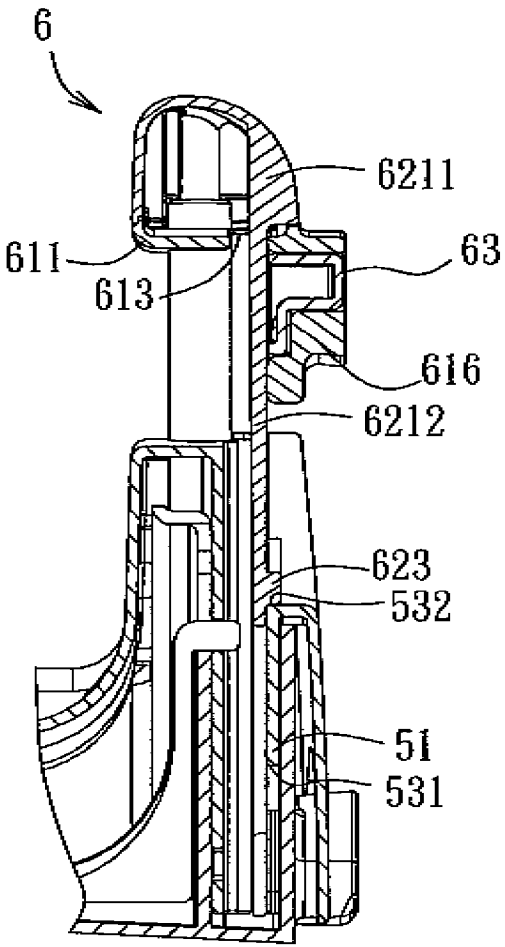
FIG. 17 is a fragmentary schematic sectional view illustrating the stop piece located at an upper arc edge, according to the second embodiment.

Referring to FIGS. 16 and 17, when a user wishes to adjust the armrest assembly 6 higher, by depressing the pressing component 63, the extension portion 6212 is moved away from the lateral side that has the lower arc edge 531 and the upper arc edge 532. When the extension portion 6212 is moved, the connected stop piece 623 is also moved away from the access opening 612 and the lower arc edge 531, which releases the armrest assembly 6 from the secured position and allows the armrest assembly 6 to be pulled upward until the stop piece 623 moves above the upper arc edge 532.

At this time, the pressing component 63 may be released such that the horizontal return force of the extension portion 6212 moves the extension portion 6212 of the latching component 62 towards the lateral side that has the lower arc edge 531 and the upper arc edge 532. The pressing component 63 is also moved outwards in a connected movement due to contact between the pressing component 63 and the extension portion 6212. The movement of the extension portion 6212 causes a connected movement of the stop piece 623, extending the stop piece 623 through the corresponding access opening 612 and joining the stop piece 623 with the corresponding upper arc edge 532. The lateral wall of the seat body 51 that forms the upper arc edge 532 then supports the armrest assembly 6. The dimensions of the stop piece 623 and the thickness of the lateral wall that forms the upper arc edge 532 are large enough to stably support a user's arm resting on the armrest assembly 6. Accordingly, relative downward movement of the armrest assembly 6 with respect to the armrest support 5 is restricted, and the armrest assembly 6 is securely positioned at a raised position with respect to the armrest support 5.

When a user wishes to adjust the armrest assembly 6 lower, by depressing the pressing component 63, the stop piece 623 may be disengaged from the upper arc edge 532, releasing the armrest assembly 6 from the securely positioned state. The armrest assembly 6 can then be moved downwards until the stop piece 623 is moved below the lower arc edge 531. At this time, the stop piece 623 can be extended through the access opening 612 to join the stop piece 623 with the lower arc edge 531, which restricts relative upward movement of the armrest assembly 6 with respect to the armrest support 5. In addition, the horizontal board portion 611 abuts against the top of the seat body 51 of the armrest support 5. In other words, the top of the seat body 51 of the armrest support 5 supports the armrest assembly 6, thereby allowing the armrest assembly 6 to securely support a user's arm resting thereon. Accordingly, the armrest assembly 6 may be securely positioned at a lowered position when the stop piece 623 passes through the access opening 612 and engages the lower arc edge 531. The stability of support in either the raised or lowered position is therefore assured.

The extension portion 6212 of the latching component 62 may be displaced by either the horizontal return force of the extension portion 6212 or a force transmitted by the pressing component 63. In other embodiments, the extension portion 6212 may be pushed or pulled through direct contact by a user to displace the extension portion 6212 and to cause a linked movement of the stop piece 623. The direct contact may be made through the receiving hole 614 or through an open space of the armrest support 5. Alternatively, the extension portion 6212 may include a protrusion that may be pulled or operated to cause the extension portion 6212 to be displaced.

In the embodiment, the upper arc edge 532 and the lower arc edge 531 act as restraining parts for holding the armrest assembly 6 and the armrest support 5 in a fixed relative vertical position when the stop piece 623 is extended through the access opening 612 to engage a restraining part, such as the upper arc edge 532 or the lower arc edge 531. In other embodiments, the restraining parts may include protrusions, openings, ridges, interlocking, or other components that interact with the stop piece 623 and that restrict relative vertical movement between the armrest assembly 6 and the armrest support 5. For example, in other embodiments, the stop piece 623 may have an opening that receives a corresponding protruding restraining part of the armrest support 5.

To sum up, through a simple operation that involves pressing the pressing component 43, 63, the child booster seat 101, 102 allows the armrest assembly 4, 6 to be released from the securely positioned state relative to the armrest support 3, 5 and adjusted to a desired height.

While various embodiments have been described in connection with particular examples, it should be understood that the invention is not limited to the disclosed embodiments but is intended to cover various arrangements included within the spirit and scope of the broadest interpretation so as to encompass all such modifications and equivalent arrangements.

What is claimed is:

1. A child booster seat, comprising:

a seat base;

an armrest support coupled to said seat base and formed with an installation space that opens upward, said armrest support having a wall confronting said installation space and formed with a plurality of restraining parts located at different heights of said armrest support; and an armrest assembly including a latching component including a tongue board that extends into said installation space and that is movable vertically within said installation space, and a stop piece that projects from said tongue board for engaging selectively said restraining parts, and an armrest component coupled to said tongue board and vertically co-movable with said tongue board relative to said armrest support, said armrest component being supported at a selected height of said armrest support when said stop piece engages one of said restraining parts;

wherein said tongue board is operable to move said stop piece relative to said armrest component for disengaging said restraining parts and permitting height adjustment of said armrest assembly relative to said armrest support;

wherein said armrest component is formed with a slot that opens upward and an access opening in spatial communication with said slot, said tongue board being received in said slot, said stop piece protruding through said access opening when said stop piece engages one of said restraining parts.

2. The child booster seat as claimed in claim 1, wherein said restraining parts include a first stop opening and a second stop opening that are formed in said armrest support and that are vertically spaced apart from each other.

3. The child booster seat as claimed in claim 1, wherein said armrest assembly further includes a pressing component that is installed on said armrest component, and that has a pressing side and a pushing side, said pushing side abutting against said tongue board of said latching component such that a horizontal force on said pressing side is transmitted to said tongue board to move said stop piece relative to said armrest component for disengaging said restraining parts.

4. The child booster seat as claimed in claim 3, wherein said pressing component is located at a height position between said stop piece and a coupling junction between said tongue board and said armrest component.

5. The child booster seat as claimed in claim 3, further comprising a position limiting mechanism provided on said armrest support and said armrest component for limiting vertical movement of said armrest component relative to said armrest support.

6. The child booster seat as claimed in claim 5, wherein said position limiting mechanism includes a hole-defining portion that is provided on one of said wall of said armrest support and said armrest component and that defines a position limiting hole, and a position limiting block that is provided on the other one of said wall of said armrest support and said armrest component and that extends into said position limiting hole to limit the vertical movement of said armrest component relative to said armrest support.

7. The child booster seat as claimed in claim 3, wherein said armrest assembly further includes a return spring located between said tongue board and said armrest component for biasing said tongue board to move said stop piece toward said restraining parts.

8. The child booster seat as claimed in claim 7, wherein said tongue board has one end that is opposite to said stop piece and that is pivotable relative to said armrest component about a horizontal axis.

9. The child booster seat as claimed in claim 8, wherein:

one of said tongue board and said armrest component is formed with an indentation;

the other one of said tongue board and said armrest component is formed with a protrusion; and said return spring has a first spring end sleeved on said protrusion and a second spring end received in said indentation.

10. The child booster seat as claimed in claim 1, wherein said restraining parts include vertically spaced apart upper and lower arc edges on said wall of said armrest support, and said stop piece has a peripheral contour conforming with those of said upper and lower arc edges.

11. The child booster seat as claimed in claim 10, wherein said armrest component includes a vertical board portion that is formed with said access opening, and a horizontal board portion that is connected to a top end of said vertical board portion and that is formed with said slot;

said tongue board having a top portion that is connected to said horizontal board portion, and an extension portion that extends downwardly from said top portion, that is received in said slot, and that is formed with said stop piece.

12. The child booster seat as claimed in claim 11, further comprising a position limiting mechanism provided on said armrest support and said armrest component for limiting vertical movement of said armrest component relative to said armrest support.

13. The child booster seat as claimed in claim 12, wherein said position limiting mechanism includes a limit block protruding from said vertical board portion, and a stop block protruding from said armrest support into said installation space and vertically aligned with said limit block, and wherein engagement between said limit block and said stop block prevents said armrest assembly from separating from said armrest support when said armrest assembly is moved vertically upward relative to said armrest support.

14. The child booster seat as claimed in claim 11, wherein said extension portion is deformable by a horizontal force to move said stop piece relative to said armrest component for disengaging said restraining parts.

15. The child booster seat as claimed in claim 14, wherein said extension portion is resilient and biases said stop piece toward said restraining parts.

16. The child booster seat as claimed in claim 14, wherein said armrest assembly further includes a pressing component that is installed on said armrest component, and that has a pressing side and a pushing side, said pushing side abutting against said extension portion such that the horizontal force on said pressing side is transmitted to said extension portion to move said stop piece relative to said armrest component for disengaging said restraining parts.

17. The child booster seat as claimed in claim 16, wherein said pressing component is located at a height position between said top portion and said stop piece.

18. A child booster seat, comprising:

a seat base;

an armrest support coupled to said seat base and formed with an installation space that opens upward, said armrest support having a wall confronting said installation space and formed with a plurality of restraining parts located at different heights of said armrest support; and an armrest assembly including a latching component including a tongue board that extends into said installation space and that is movable vertically within said installation space, and a stop piece that projects from said tongue board for engaging selectively said restraining parts, and an armrest component coupled to said tongue board and vertically co-movable with said tongue board relative to said armrest support, said armrest component being supported at a selected height of said armrest support when said stop piece engages one of said restraining parts;

wherein said tongue board is operable to move said stop piece relative to said armrest component for disengaging said restraining parts and permitting height adjustment of said armrest assembly relative to said armrest support;

wherein said armrest assembly further includes a pressing component that is installed on said armrest component, and that has a pressing side and a pushing side, said pushing side abutting against said tongue board of said latching component such that a horizontal force on said pressing side is transmitted to said tongue board to move said stop piece relative to said armrest component for disengaging said restraining parts.

* * * * *